US010639644B2

(12) United States Patent
Janetta

(10) Patent No.: US 10,639,644 B2
(45) Date of Patent: May 5, 2020

(54) LABORATORY MILL

(71) Applicant: Retsch GmbH, Haan (DE)

(72) Inventor: Frank Janetta, Bottrop (DE)

(73) Assignee: Retsch GmbH, Haan (DE)

( * ) Notice: Subject to any disclaimer, the term of this patent is extended or adjusted under 35 U.S.C. 154(b) by 0 days.

(21) Appl. No.: 16/089,815

(22) PCT Filed: Apr. 3, 2017

(86) PCT No.: PCT/EP2017/025075
§ 371 (c)(1),
(2) Date: Sep. 28, 2018

(87) PCT Pub. No.: WO2017/167460
PCT Pub. Date: Oct. 5, 2017

(65) Prior Publication Data

US 2019/0126285 A1 May 2, 2019

(30) Foreign Application Priority Data

Apr. 1, 2016 (DE) ..... 10 2016 003 746
Dec. 9, 2016 (DE) ..... 10 2016 014 636

(51) Int. Cl.
*B02C 23/00* (2006.01)
*G10K 11/178* (2006.01)
(Continued)

(52) U.S. Cl.
CPC ..... *B02C 23/00* (2013.01); *B02C 18/062* (2013.01); *B02C 18/16* (2013.01);
(Continued)

(58) Field of Classification Search
CPC ... B02C 18/062; B02C 18/16; B02C 18/2225; B02C 23/00; G10K 11/178; G10K 2210/121; G10K 2210/129; G10K 2210/1291
USPC ..... 381/71.1, 71.2, 71.3, 71.7, 71.11, 71.14
See application file for complete search history.

(56) References Cited

U.S. PATENT DOCUMENTS 5,367,612 A * 11/1994 Bozich ..... F16F 15/02 706/23
5,701,774 A * 12/1997 Imanari ..... B21B 37/52 72/8.6
(Continued)

FOREIGN PATENT DOCUMENTS

CH 512935 A 9/1971
DE 102009024343 A1 12/2010
(Continued)

OTHER PUBLICATIONS

International Search Report for PCT/EP2017/025075 dated Jul. 7, 2017, 8 pages.
(Continued)

*Primary Examiner* — Paul Kim
*Assistant Examiner* — Friedrich Fahnert
(74) *Attorney, Agent, or Firm* — FisherBroyles, LLP; Craig W. Mueller

(57) ABSTRACT

The invention relates to a laboratory mill comprising at least one counter-vibration device (27) which has at least one control unit (29*a*) for providing a counter-vibration signal (29*b*) and at least one controllable vibration generation unit (29) for converting the counter-vibration signal (29*b*) into counter-vibrations (30), wherein the vibration-generation unit (29) counteracts a device- and/or housing part (31) of the laboratory mill (1) and the counter-vibrations (30) lead to an active reduction in the vibrations of the device- and/or housing part (31) and/or an at least partial suppression of noise-inducing vibrations of the device- and/or housing part (31), by means of destructive interference.

18 Claims, 8 Drawing Sheets

Figure 1:
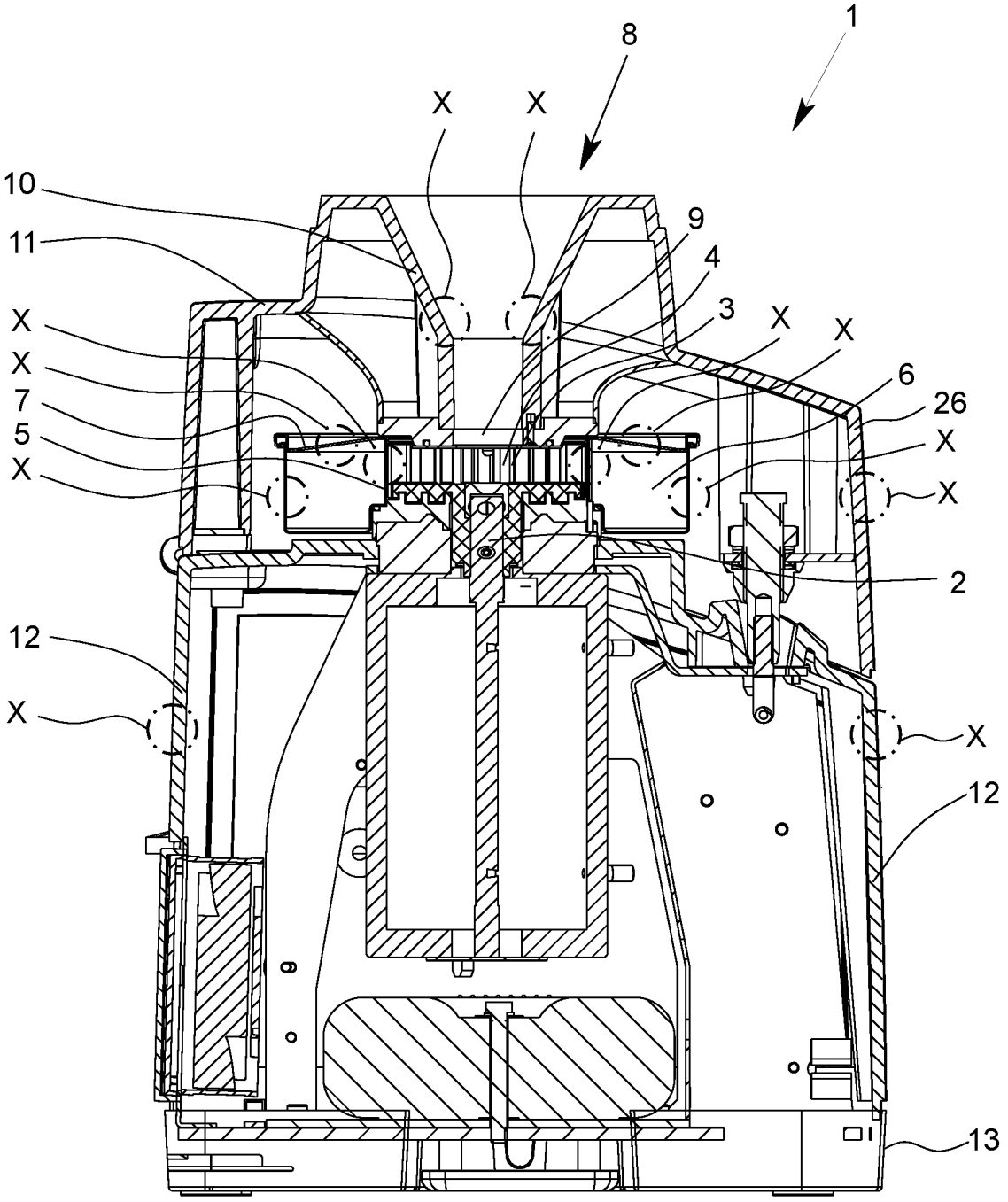

(51) Int. Cl.
*B02C 18/16* (2006.01)
*B02C 18/22* (2006.01)
*B02C 18/06* (2006.01)

(52) U.S. Cl.
CPC ..... *B02C 18/2225* (2013.01); *G10K 11/178* (2013.01); *G10K 2210/121* (2013.01); *G10K 2210/129* (2013.01); *G10K 2210/1291* (2013.01)

(56) References Cited

U.S. PATENT DOCUMENTS

| | | | | |
|---|---|---|---|---|
| 2007/0138338 | A1* | 6/2007 | Luo | B64D 27/00 244/54 |
| 2014/0367508 | A1* | 12/2014 | Verdugo | B41J 29/48 242/563.1 |
| 2015/0063621 | A1* | 3/2015 | Lilley, Jr. | H04R 1/347 381/345 |
| 2017/0358290 | A1* | 12/2017 | Alberts | E03C 1/2665 |

FOREIGN PATENT DOCUMENTS

| | | | |
|---|---|---|---|
| DE | 102012210270 | A1 | 12/2013 |
| WO | 2007080030 | A1 | 7/2007 |
| WO | 2016073254 | A1 | 5/2016 |

OTHER PUBLICATIONS

Written Opinion for PCT/EP2017/025075 dated Jul. 7, 2017, 7 pages.

* cited by examiner

LABORATORY MILL

This application is the National Phase of PCT Application No. PCT/EP2017/025075, filed Apr. 3, 2017, which claims the benefit of German Patent Application Serial Nos. 102016014636.2 and 102016003746.6, filed with the German Patent and Trade Mark Office on Dec. 9, 2016 and Apr. 1, 2016, respectively.

The invention relates to a laboratory mill, in particular a rotor mill or centrifugal mill or conical mill, more particularly comprising a milling chamber for a sample volume of preferably less than 10 l, particularly preferably less than 5 l, more preferably less than 2 l. In particular, the invention relates to a laboratory mill that is portable as a functional unit, more particularly formed as a tabletop or free-standing device for use in a laboratory or designed, for example, for the inline measurement of quality parameters of samples from a partly or fully automated process for the production and/or processing of a sample material.

In many laboratory mills operating according to the impact and/or cutting principle, acousto-structural effects occur when the sample is being worked on and/or processed due to the operations involved in such processes, i.e. vibrating structures radiate airborne sound or relay said sound into adjacent components as structure-borne sound, which components then likewise radiate airborne sound, or airborne sound produced inside the device when the sample is being worked on and/or processed exits the laboratory mill and enters the surrounding area via a continuous airborne-sound path. Within the meaning of the invention, "sound" or "disruptive sound" refers to generally audible noises or the audible vibrations (sound waves) of pressure and density fluctuations in the air.

Laboratory mills operating according to the impact and/or cutting principle produce sound emissions due to the comminution processes occurring during the milling procedure. In rotor mills or centrifugal mills, high centrifugal forces acting on the parts being comminuted due to a fast-rotating milling tool lead to violent jolts during the milling process. In other laboratory mills, the movement pattern may be calmer, although airborne and structure-borne sound emissions still emanate from the milling chamber due to the actions carried out on the sample, in particular due to a cutting action of the rotor. Airborne and structure-borne sound emissions may be caused by rotating and/or vibrating milling tools or also by the movement course of milling members that are used, for example, in conical mills to comminute the sample material and follow the movement of a sample container within said sample container. The sound emissions can be produced by the comminution procedure itself, or by a developing air flow that is interrupted cyclically by the periodic milling procedure.

If milling stock is intended to be fed into the milling chamber gradually or removed from the milling chamber through a milling stock tube during a milling procedure, the milling stock tube generally remains open during a milling process and there is a continuous airborne-sound path between the emission source in the region of the milling tool and the area surrounding the comminution machine. Airborne sound can then exit the milling chamber through the milling stock tube and enter the surrounding area.

To reduce sound emissions, it is already known from the prior art to equip laboratory mill housing parts with sound-absorbing materials. For sound insulation purposes, the laboratory mill can also be completely encased. However, the device cannot be completely encapsulated by a sound-insulation casing during operation if milling stock is intended to be fed into the milling chamber gradually or removed from the milling chamber through a milling stock tube during a milling process. In order to reduce the sound emissions through the milling stock tube, it is possible to close the milling stock tube during the time between when milling stock is fed into and removed from the chamber. However, repeated opening and closing of the milling stock tube is not very user-friendly, which means that in practice the milling stock tube is often left uncovered during the entire milling process and disruptive sound emissions are put up with.

An object of the present invention is to produce a laboratory mill of the type mentioned at the outset that exhibits significantly reduced sound radiation while the sample is being worked on and/or processed. A particular object of the present invention is to reduce sound emissions in the region of a milling stock tube in a laboratory mill in a technically simple and cost-effective manner, as far as possible without hindering the feed of milling stock into the milling chamber and, where applicable, removal of the stock therefrom during operation.

In a first embodiment of the invention, to achieve the aforementioned objects for a laboratory mill, at least one counter-vibration apparatus is provided, which has at least one control unit for providing a counter-vibration signal and at least one actuable vibration-generation unit for converting the counter-vibration signal into counter-vibrations, wherein the vibration-generation unit acts counter to a device and/or housing part of the laboratory mill and wherein, by means of the counter-vibrations, vibrations of the device and/or housing part are actively reduced and/or vibrations of the device and/or housing part that generate disruptive sound are eliminated at least in part by means of destructive interference.

In this embodiment, a vibration-generation unit acts counter to a device and/or housing part in order to reduce, by means of counter-vibrations, the amplitude of the vibrations of the affected device and/or housing part that are produced during operation of the laboratory mill and thus to reduce disruptive sound. This aspect of the invention involves positively influencing the vibration behavior of the device and/or housing parts by generating counter-vibrations or attenuating the amplitude of the vibrations of the device and/or housing part in order to prevent the formation of disruptive sound or at least reduce the formation of disruptive sound. The device and/or housing part is excited by vibrations in phase opposition such that vibrations of the device and/or housing part that are caused by the operation of the laboratory mill, in particular due to a high rotational speed in rotor or centrifugal mills and/or due to the milling procedure itself, as in conical mills, are reduced and preferably completely eliminated.

In a particularly preferred embodiment, the device and/or housing part is a laboratory mill housing lid enclosing a milling chamber or a laboratory mill housing that can be mounted on a base, it being possible for the housing to enclose a drive of the laboratory mill. In order to further reduce emissions of disruptive sound, the counter-vibration apparatus can be designed and arranged to excite the housing and housing lid together in phase opposition in a manner coordinated with one another. The housing and housing lid can form a common enclosure for the laboratory mill, the counter-vibration apparatus being designed and arranged to cause the enclosure to vibrate therewith in phase opposition. Controlling the phase-opposition excitation of the housing and housing lid such that they are coordinated with one another makes it possible to achieve particularly good vibration attenuation. Tests carried out in connection with the invention have shown that the vibrations of the housing and housing lid often mutually reinforce each other, and so very good vibration attenuation properties can be achieved in particular when the phase-opposition excitement of the housing and of housing lid are controlled such that they are coordinated.

It goes without saying that the housing and housing lid can both be formed from multiple parts, and so a plurality of vibration-generation units are provided as necessary in order to excite each device and/or housing part in phase opposition and in a coordinated manner.

The vibration-generation unit can be an electromechanical actuator that is placed on the device and/or housing part and/or interacts with the device and/or housing part. A piezoelectric actuator may be used as an electromechanical actuator. By using piezoelectric actuators, the vibrating mass of the device and/or housing part can be actively damped. An electromechanical actuator can also be formed by a spring-mass vibration system that is powered by a drive and coupled to a component wall of the laboratory mill.

The vibration-generation unit can also be integrated in a wall of the device and/or housing part. The free installation space within the laboratory mill enclosure can thus be utilized optimally and the vibration-generation unit does not hinder the arrangement of other components within the laboratory mill. Moreover, when the vibration-generation unit is integrated in the wall of the device and/or housing part, an aesthetically pleasing overall impression can be ensured.

In addition, at least one sensor can be provided for detecting vibrations generating disruptive sound and/or for detecting disruptive sound and generating a vibration signal, the control unit being configured to generate the counter-vibration signal by evaluating the vibration signal. The sensor can be an accelerometer, for example. The period/frequency, amplitude and/or phase angle/phase of the vibrations of the device and/or housing part can be detected by the sensor. The counter-vibration signal is preferably generated such that the vibration-generation unit generates counter-vibrations of the same frequency but having a phase position shifted by 180°, such that the vibrations of the device and/or housing part caused by the milling operation and the generated counter-vibrations cancel each other out as a result of destructive interference or at least the amplitude of the vibrations of the device and/or housing part caused by the milling operation is reduced.

In an advantageous embodiment, the vibration-generation unit can be releasably connected to a device and/or housing part and/or can be attached to different device and/or housing parts as necessary. The vibration-generation unit can thus be specifically arranged at points on the laboratory mill that emit disruptive sound during operation of the laboratory mill. Active vibration reduction can also be achieved by arranging the vibration-generation unit on a device and/or housing part only when sound is emitted at a particular intensity.

The vibration-generation unit can also be designed and arranged to actively excite a (separate) feed funnel and/or a device stand of the laboratory mill in phase opposition. For this purpose, the vibration-generation unit can be arranged on and/or in a wall capable of vibrating. For example, the laboratory mill device stand can be excited in phase opposition in order to actively reduce the vibrations occurring in the region of the device stand during operation of the laboratory mill. Additionally, the device stand can be decoupled by means of passive dampers, e.g. rubber elements, by means of which the laboratory mill rests on a base. The combination of actively exciting the device stand in phase opposition with passive device stand damping by means of damping elements is inventive in itself.

The control unit can comprise at least one adjustment member for manually generating a counter-vibration signal and/or modifying the phase position and/or amplitude of the counter-vibrations. The invention thus makes it possible to subjectively assess vibration attenuation achieved by counter-vibrations and achieve improved vibration attenuation by modifying the counter-vibrations, where necessary.

In addition, at least one sensor can be provided for detecting an operational parameter of the laboratory mill, in particular the motor speed of a drive unit of the laboratory mill. The control unit can be designed to provide the counter-vibration signal depending on the detected operational parameter of the laboratory mill. Preferably, the motor speed can be measured and counter-vibrations of a determined phase position and amplitude are generated solely depending on the motor speed level. In this respect, the typical vibration behavior of the laboratory mill during different operational states can be detected in terms of period/frequency, amplitude and phase angle/phase of the vibrations and stored in a memory of the control unit as a vibration characteristic map for the counter-vibrations to be generated. The controller can be configured to actuate the vibration-generation unit so as to emit predetermined counter-vibrations stored in the memory. In principle, it is then possible to omit sensors for detecting vibrations of the device and/or housing part that generate disruptive sound and/or sensors for directly detecting disruptive sound. Preferably, the control unit can be designed such that counter-vibrations of a particular predetermined (stored) phase position and amplitude are always generated at a particular motor speed.

It is possible and advantageous to combine measures for eliminating and/or reducing disruptive sound by means of a counter-vibration apparatus with measures for eliminating and/or reducing disruptive sound by means of an anti-sound system. Below, the option to eliminate and/or reduce disruptive sound by means of an anti-sound system will be described in more detail.

In this context, a counter-sound apparatus can be provided in a laboratory mill, which apparatus has a control unit for providing a counter-sound signal and at least one actuable sound-generation unit for converting the counter-sound signal into counter-sound for active sound reduction, i.e. for reducing the amplitude of the disruptive sound and/or for at least partly eliminating the disruptive sound by means of destructive interference. As in the counter-vibration generation described above, the active elimination or sound reduction of the sound events emanating from the laboratory mill can be achieved by adjusting the frequency and amplitude of the sound-generation unit acting as the active exciter. The invention thus also proposes an anti-sound system to be used in a laboratory mill to reliably reduce or even completely eliminate disruptive sound emissions. In particular, irritating sound emissions can be reduced by an anti-sound system in a way that improves on the results of sound emission reduction using sound insulation and/or sound attenuation measures.

In addition to reducing sound emissions by counter-sound, other, in particular passive measures, e.g. sound insulation or sound attenuation, can also be used according to the invention for sound reduction. In this case, it is in particular possible to reduce sound emissions by counter-sound specifically for frequencies or frequency ranges that cannot be suppressed to the desired extent by other passive sound reduction measures. In particular, lower frequencies can be eliminated effectively by means of counter-sound, whereas higher frequencies can often also be suppressed by conventional sound attenuation.

Eliminating irritating sound waves by counter-sound is based on the principle of destructive interference, in which sound waves of the same frequency but having a phase position shifted by 180° are superimposed on the sound waves such that the waves cancel each other out by interference. Since in practice individual frequencies are not emitted as irritating sound, but rather a spectrum of irritating sound waves typically occurs, the counter-sound is selected such as to have the same spectrum of frequencies as far as possible, it being possible in each case to have a phase position shifted by at least substantially 180°. Even if the entire spectrum of the irritating emitted sound may not be able to be eliminated in this way, a significant reduction in sound emissions can still be achieved. The same applies to the aforementioned vibration attenuation by means of counter-vibrations.

The technique of emitting counter-sound to eliminate irritating sound waves or at least reduce the amplitude thereof is well known to a person skilled in the art. This technique is often referred to as Active Noise Reduction (ANR), Active Noise Cancellation (ANC) or anti-sound.

Anti-sound systems can, for example, use a "Filtered-x Least Mean Square" (FxLMS) algorithm, which attempts to regulate the airborne sound carried in the laboratory mill and/or emanating from the laboratory mill down to zero (in the case of sound elimination) or to a predetermined threshold (in the case of sound influencing) by outputting counter-sound. However, it is stressed that the present invention is not limited to the use of an FxLMS algorithm. If the frequency of the airborne sound waves carried in the laboratory mill and/or emitted from the laboratory mill is the same as that of the anti-sound or counter-sound waves generated by the sound-generation unit and the waves are phase-shifted relative to one another by 180° but the amplitude of the sound waves is different, the emitted airborne sound waves are simply attenuated. For each frequency range of the emitted airborne sound, the anti-sound can be calculated separately by means of the FxLMS algorithm by determining a suitable frequency and phase position of two sine waves shifted relative to one another by 90° and calculating the necessary amplitudes for these sine waves. The aim of the anti-sound system in this case is for the sound elimination or sound influencing to be audible and measurable at least outside the laboratory mill.

According to the invention, the term "counter-sound" or "anti-sound" is used to distinguish between airborne sound carried in the laboratory mill and/or airborne sound or disruptive sound emitted by the laboratory mill. Taken in isolation, the counter-sound is regular airborne sound.

A piezoelectric actuator, in particular a piezoelectric film or a piezoceramic disc element, can be used as a sound-generation unit, the piezoelectric actuator itself generating a counter-sound field depending on its actuation. Actuators of this kind will be referred to as "electroacoustic actuators" hereinafter. Piezoelectric actuators are power converters and translate electrical signals into a mechanical displacement and can thus have a regulating effect in control systems. Industrially manufactured piezoelectric elements are mostly ceramics. These ceramics are made from synthetic, inorganic, ferroelectric and polycrystalline ceramic materials. When an electrical voltage is applied, the piezoceramic extends towards the electrical field. By applying an AC voltage, airborne sound waves that are superimposed on the disruptive-sound field can be produced using piezoelectric actuators. The generated counter-sound field or compensation-sound field is superimposed on the disruptive-sound field and thus leads to the disruptive sound being eliminated or at least the amplitude thereof being reduced.

As an electroacoustic actuator, the piezoelectric actuator preferably has a high a ratio as possible of its surface to its thickness so as to achieve sufficiently high sound intensity or a sufficiently high sound pressure level when generating counter-sound. Optionally, the piezoelectric actuator can also be coupled to a membrane.

In an advantageous embodiment of the invention, the sound-generation unit is a piezoelectric film. Piezoelectric films have thin walls and can thus be applied to a device and/or housing wall of the laboratory mill without any structural alterations to the laboratory mill. When using piezoelectric films, it is no longer necessary to make openings in order to insert speakers into the wall. In principle, however, the invention also allows for conventional speakers to be used instead of piezoelectric films. One advantage of speakers of this kind is their availability and the generation of a high sound level.

The sound-generation unit can also be formed by an arrangement having an electromechanical actuator that interacts with a laboratory mill device and/or housing part that is arranged so as to be capable of vibrating. As a result of the displacement of an electromechanical actuator, the device and/or housing part itself is made to vibrate and the device and/or housing part then generates a counter-sound field. The electromechanical actuator forms an active oscillator that engages directly on a device and/or housing part capable of vibrating and makes the device and/or housing part vibrate, thus producing a counter-sound field. The device and/or housing part is then used as a speaker. In this case, the device and/or housing part acts as a membrane to generate counter-sound.

A piezoelectric actuator may also be used as an electromechanical actuator. An electromechanical actuator can also be formed by a spring-mass vibration system that is powered by a drive and coupled to a component wall of the laboratory mill.

In an advantageous embodiment of the invention, the laboratory mill has a sound sensor for converting disruptive sound into an interference signal, the control unit being configured to generate the counter-sound signal by analyzing the interference signal. By using a sound sensor, for example a microphone, disruptive sound from disruptive sources in the laboratory mill can be detected and converted into an interference signal. The interference signal can preferably be analyzed in terms of frequency. In the process, the interference signal can be broken down into frequency portions in real time. By means of appropriate filtering, it is possible to filter out specific frequency ranges in which disruptive sound is generated particularly loudly.

In an alternative embodiment of the invention, the control unit can be configured such that the counter-sound signal can be selected from a number of counter-sound signal profiles available in a memory unit. The profile can be selected depending on an active operating mode of the laboratory mill and/or depending on the sample materials or feedstock being processed and/or handled by the laboratory mill during operation of the laboratory mill. In a laboratory mill, the profile can preferably also be selected depending on milling stock to be comminuted, in particular on the mechanical and/or physical properties thereof. In this configuration, no sound sensor is required. Instead, the counter-sound signal profiles are generated on the basis of an analysis of disruptive sound during the course of different operating modes of the laboratory mill and/or while working on different sample materials or feed stock. In a centrifugal mill, for example, the counter-sound signals can be dependent on a milling tool rotational speed, which may vary between operating modes, and/or on the milling stock used.

The sound-generation unit is arranged within a housing of the laboratory mill, but can in principle also be provided externally on the housing. It is not necessary, and in some cases not possible in technical terms, for the sound-generation unit to be directly connected to or interact with a laboratory mill device and/or housing part that emits disruptive sound itself. Preferably, the actuator is arranged on and/or interacts with another device and/or housing part directly or indirectly adjacent to the sound-emitting device and/or housing part. It is thus possible to reduce the disruptive sound effectively in the immediate vicinity of the generation source of the disruptive sound.

It is also possible for the sound-generation unit to be integrated in a wall of a device and/or housing part of the laboratory mill. For example, by means of integrated piezoceramic actuators, vibrations can be actively introduced into a component structure in order to excite said structure and generate a counter-sound field. A piezoelectric actuator can be cast into a device and/or housing part wall and is thus given the preload necessary for use as an actuator. As a result, the piezoceramic can be optimally incorporated into the material structure of the device and/or housing part and protected from dirt.

In rotor or centrifugal mills, for example, the milling chamber causes sound emissions, and so the sound-generation unit can in particular be arranged adjacently to the milling chamber. According to the invention, during operation of the laboratory mill, airborne sound can be eliminated or at least significantly reduced by counter-sound measures in the immediate surroundings of the milling chamber, preferably inside the milling chamber. In addition, the sound-generation unit can be arranged close to a drive motor of the laboratory mill.

If the laboratory mill has a milling tool arranged in a milling chamber, as is the case in a rotor mill, the actuator can be arranged on and/or interact with a device and/or housing part that directly or indirectly encloses the milling chamber. For example, a collection container for comminuted milling stock can be provided, said container being connected to the milling chamber, in particular surrounding the milling chamber. The actuator can then be arranged on and/or interact with the collection container. Preferably, the actuator is arranged on the outside of the collection container, i.e. outside the receiving space of the collection container for comminuted milling stock. A lid of the collection container can be accordingly equipped with a counter-sound apparatus.

Alternatively, an annular sieve surrounding the milling chamber can be provided, the actuator being arranged on and/or interacting with the annular sieve. The collection container can be provided on the outer circumference of the annular sieve.

If the laboratory mill has a milling stock tube that extends through a housing of the laboratory mill as far as to the milling chamber and is provided for supplying milling stock into the milling chamber and/or removing the milling stock from the milling chamber, a continuous airborne-sound path between the emission source in the region of the milling tool and the area surrounding the comminution machine may be formed. Through the milling stock tube, airborne sound exits the inside of the comminution apparatus and reaches the surrounding area, and so it is advantageous to arrange a counter-sound apparatus in the region of the milling stock tube. At least one electroacoustic actuator can be arranged on a laboratory mill device and/or housing part that forms and/or defines the milling stock tube, and/or an electromechanical actuator can interact with the device and/or housing part such that the device and/or housing part itself is made to vibrate and generates a counter-sound field. For example, it is possible to provide an electroacoustic actuator arranged on a separate feed funnel that is inserted into a milling stock tube of the laboratory mill. Alternatively, it is also possible to provide an electromechanical actuator that acts counter to the feed funnel and makes the feed funnel itself vibrate to generate a counter-sound field. An electroacoustic actuator can also be arranged on a housing lid of the laboratory mill in order to generate anti-sound or counter-sound. It is also possible for an electromechanical actuator to interact with a housing lid in order to make the lid vibrate and thus generate a counter-sound field.

To effectively reduce a significant portion of the disruptive sound, the emission direction of the counter-sound waves should preferably match the emission direction of the disruptive-sound waves. This can be achieved by arranging the actuator appropriately.

It goes without saying that the measures and features designed for active sound reduction by the generation of counter-sound can also be provided accordingly in the above-described active vibration reduction by means of counter-vibrations, and vice versa.

In the following, preferred embodiments of the invention will be explained in more detail on the basis of schematic drawings. The aspects of the invention described on the basis of FIG. 1 to 8 are not limited to the structural designs shown in FIG. 1 to 8, and features from different embodiments can be combined as necessary.

Figure 2:
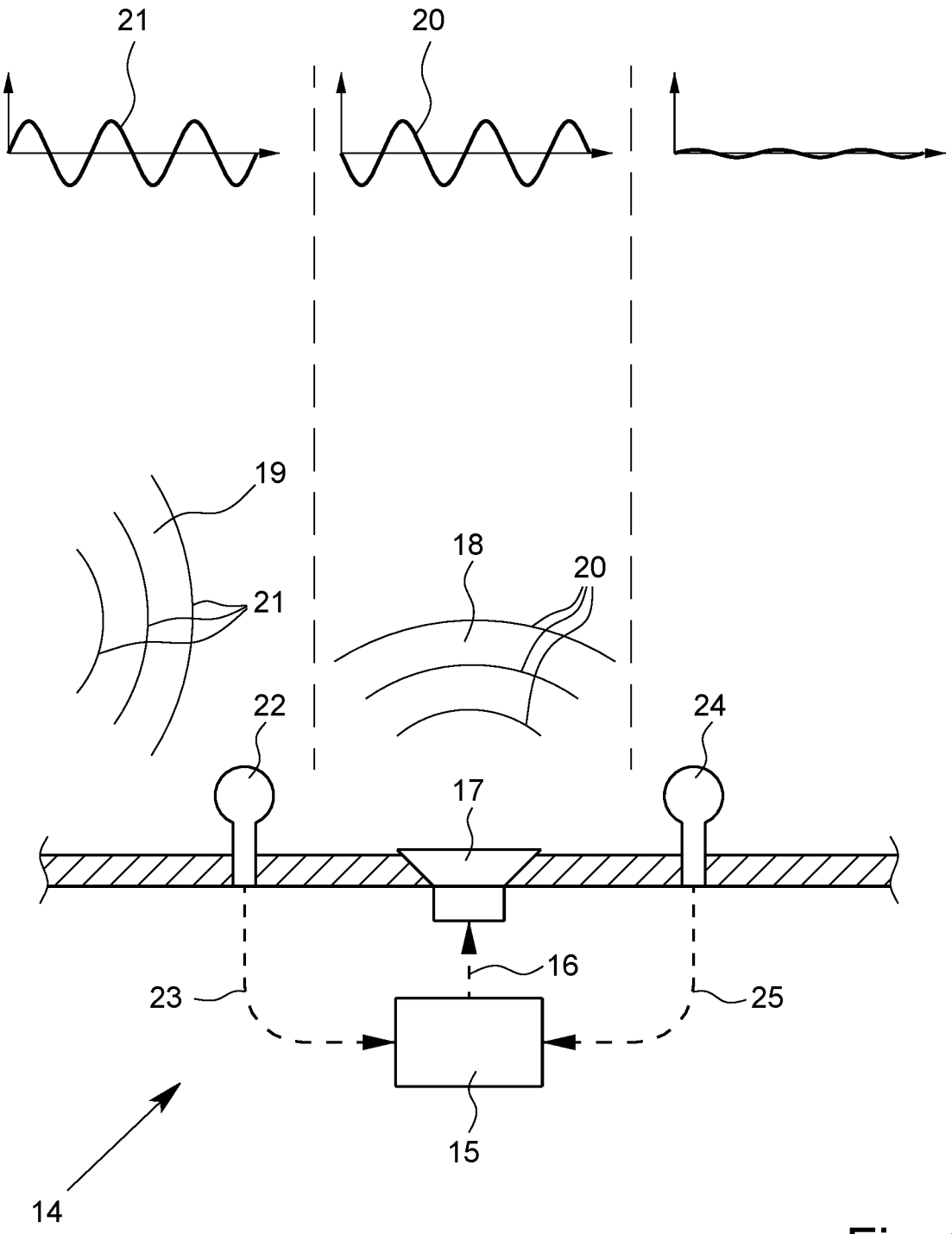
Figure 3:
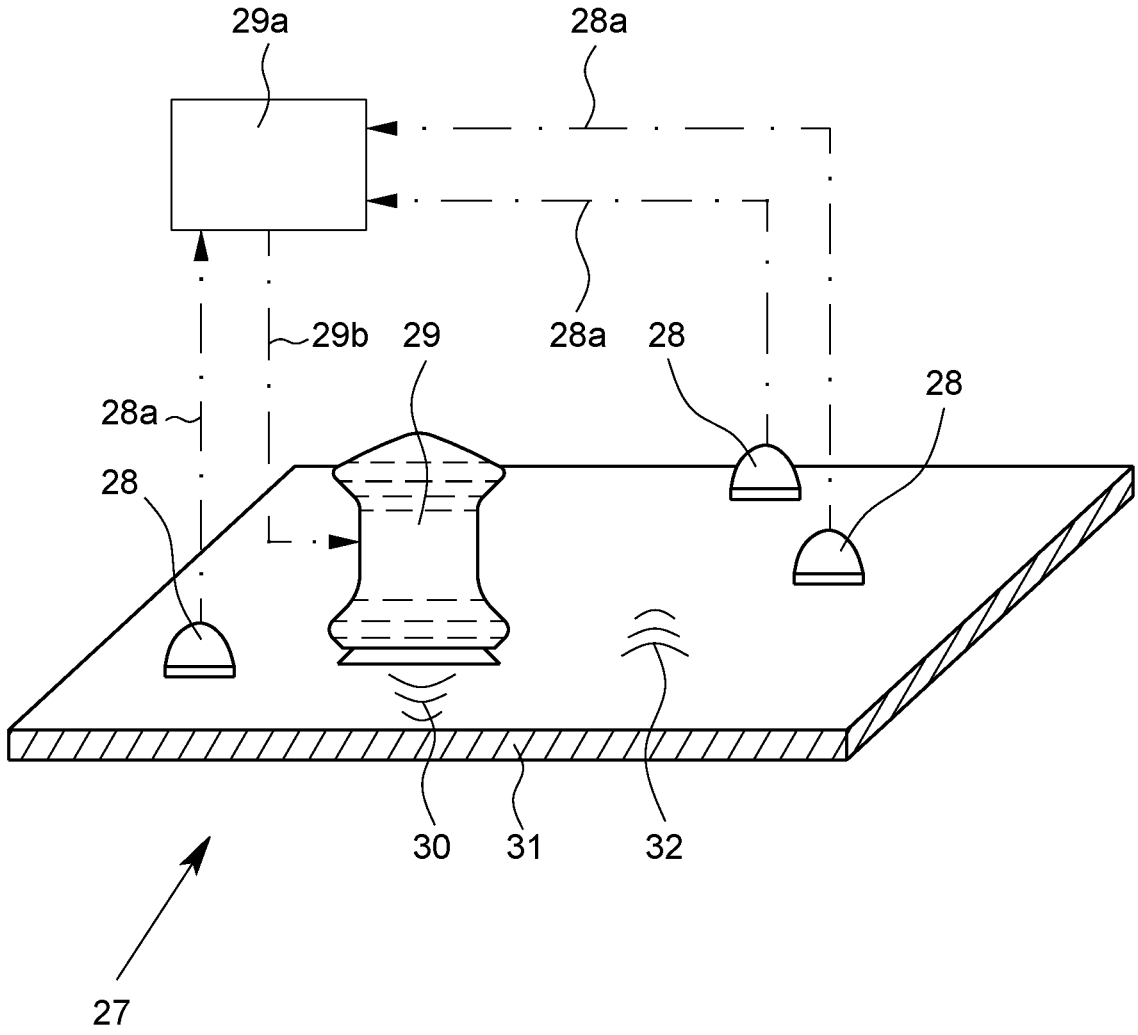
Figure 4:
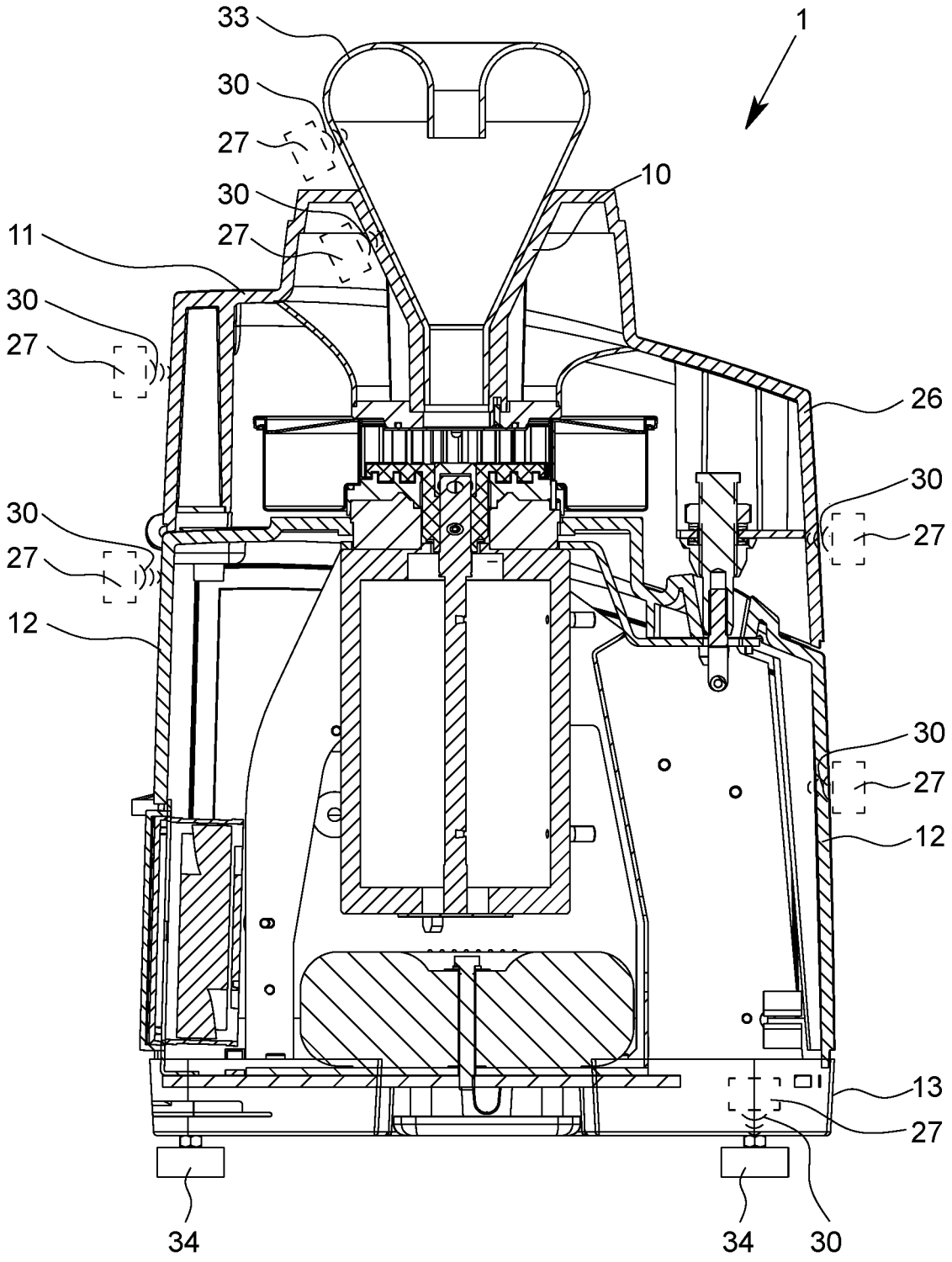
Figure 5:
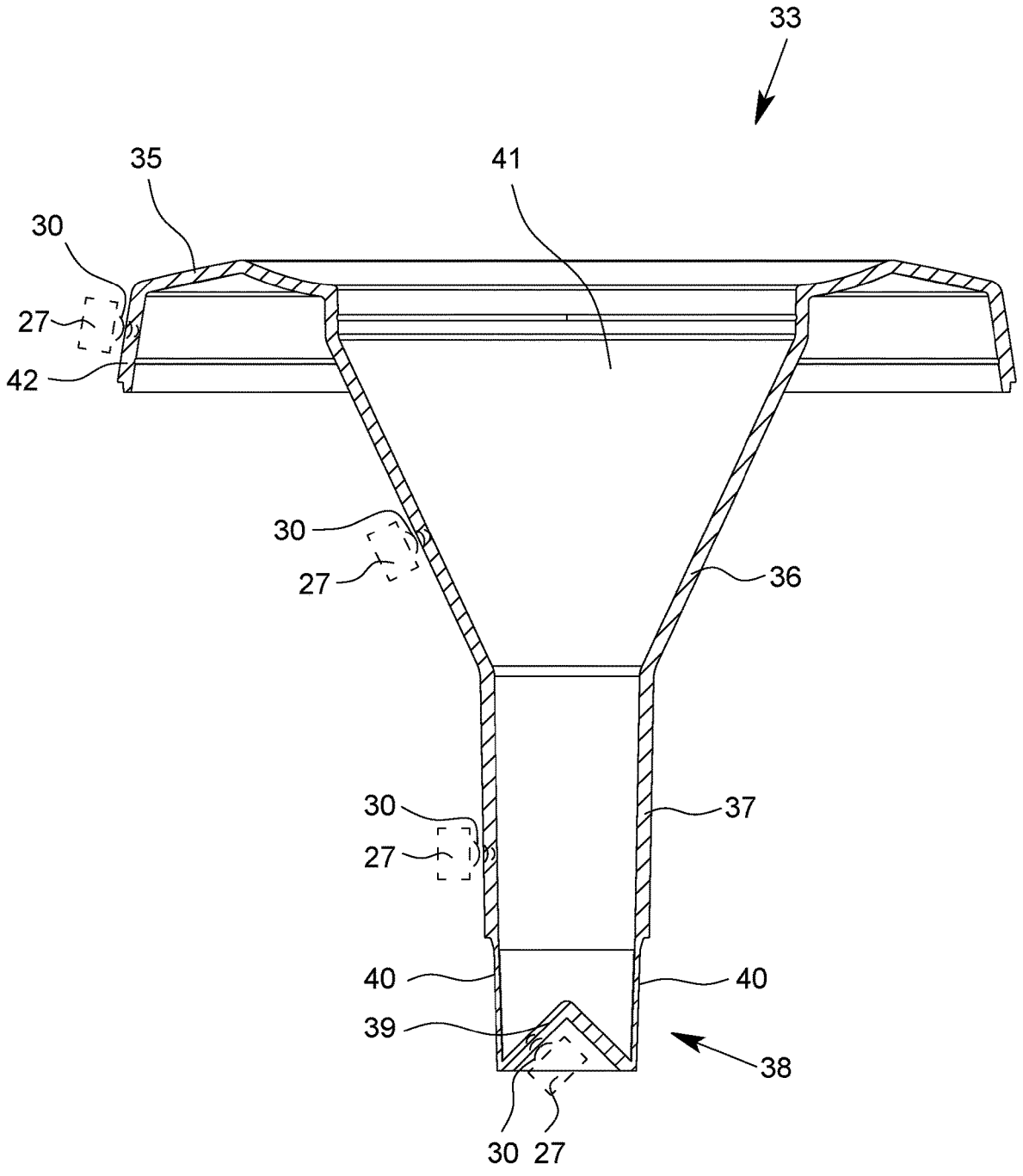
Figure 6:
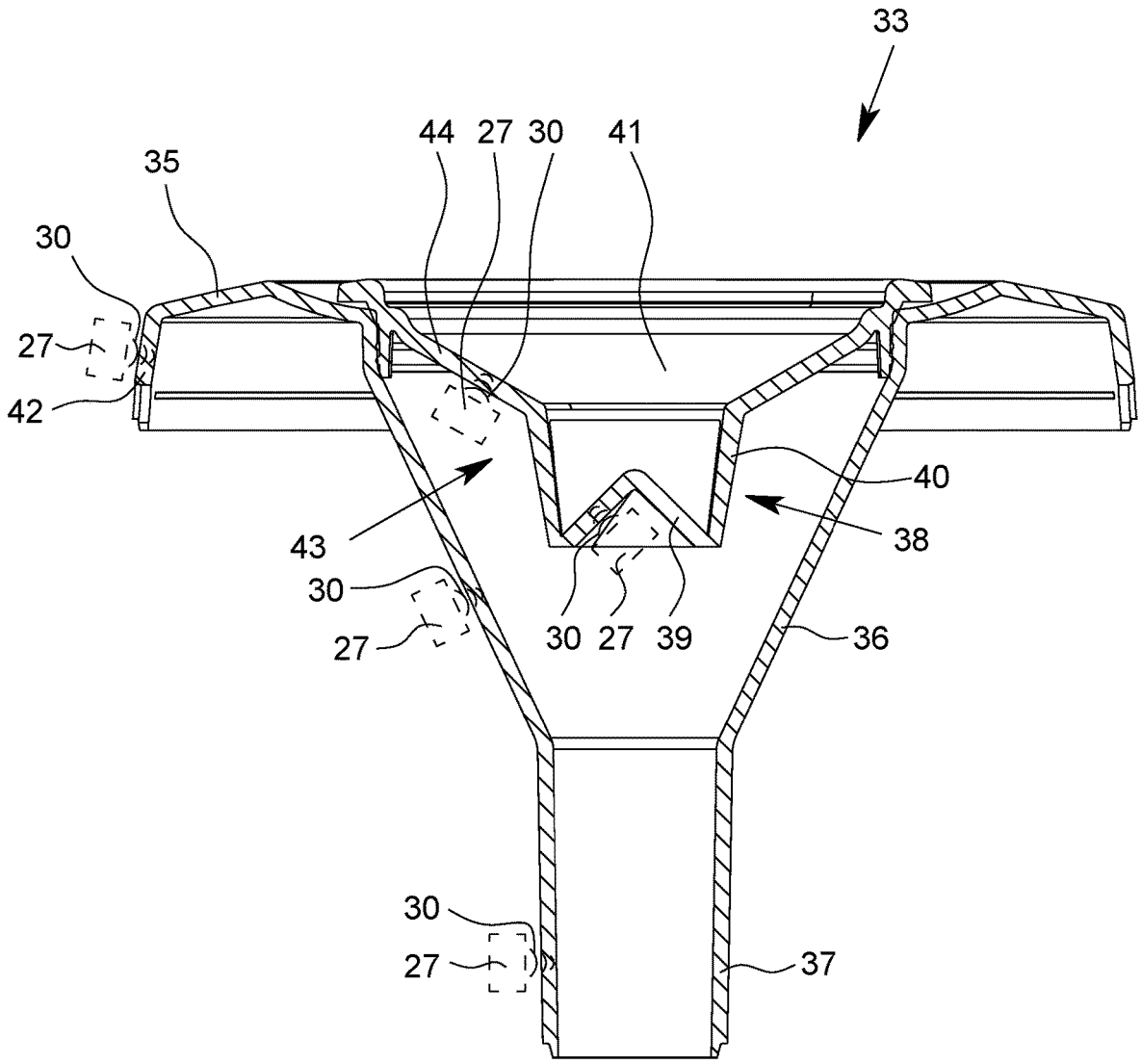
Figure 7:
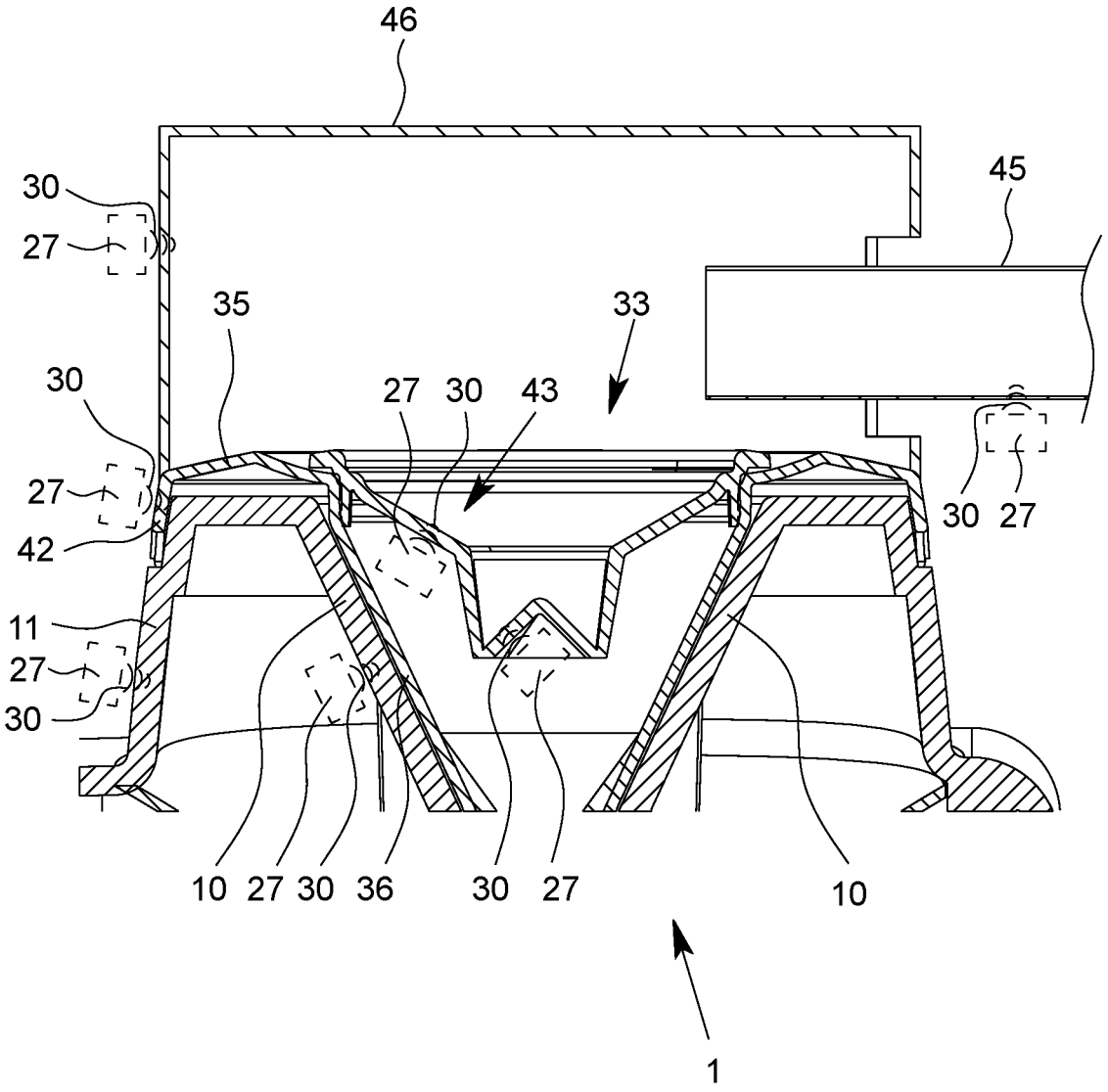
Figure 8:
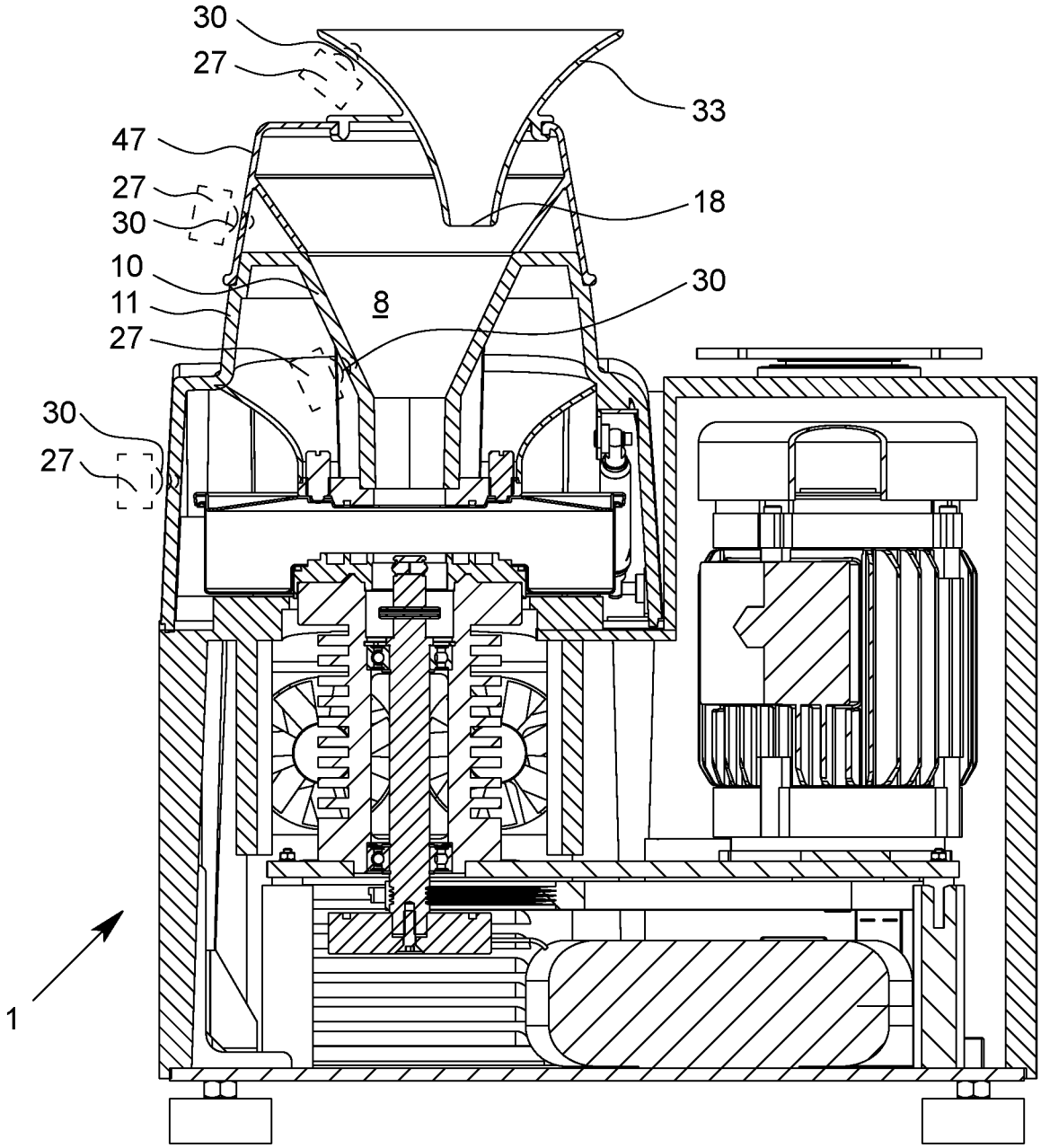

In the drawings:

FIG. 1 is a sectional view of a centrifugal mill showing possible positions for a counter-sound system, FIG. 2 is a schematic view of a counter-sound apparatus for active sound reduction and/or at least partly eliminating disruptive sound, FIG. 3 is a schematic view of a counter-vibration apparatus for actively reducing the vibrations from a device and/or housing part emitting disruptive sound and for at least partly eliminating the vibrations generating disruptive sound, FIG. 4 shows the centrifugal mill shown in FIG. 1, showing possible locations for a counter-vibration system, FIG. 5 shows a first embodiment of a separate feed funnel for use in a comminution machine for laboratory operation, possible locations for a counter-vibration system on the funnel being shown schematically, FIG. 6 shows another embodiment of a funnel for a comminution machine, FIG. 7 is a partially sectional view of the funnel from FIG. 6 inserted into the milling stock tube of a centrifugal mill, and FIG. 8 is a schematic sectional view of a laboratory mill having a separate funnel arranged above a milling stock funnel of the laboratory mill.

By way of example, FIG. 1 shows the structural design of a laboratory mill 1 in the form of a rotor mill or centrifugal mill. However, the aspects described below also apply to other laboratory mills having a different structural design, in particular to conical mills.

The laboratory mill 1 comprises a rotor 3 coupled to a drive shaft 2 and acting as a milling tool, a milling chamber 4, in which the rotor 3 rotates during a milling process, being surrounded by an annular sieve 5. On the outer circumference of the annular sieve 5, an annular collection container 6 for comminuted milling stock is arranged. The collection container 6 can be closed by a removable container lid 7.

The milling stock is fed into the milling chamber 4 through a milling stock tube 8, which is in fluid communication with a milling stock inlet opening 9. The milling stock is fed into the milling chamber 4 through the milling stock inlet opening 9. During operation of the comminution machine 1, the milling stock tube 8 can be open to the surroundings. This ensures the milling stock is fed into the milling chamber 4 gradually during the milling operation.

In the embodiment shown by way of example, the milling stock tube 8 is defined by a funnel-like wall portion 10 of a housing lid 11 of the laboratory mill 1. The housing lid 11 encloses the milling chamber 4. To further encase the laboratory mill 1, a housing 12 is also provided, which can also be formed in multiple parts and encloses a drive of the laboratory mill 1. The housing lid 11 and the housing 12 form an enclosure or envelope for the laboratory mill 1. The housing 12 rests on a base by means of a base plate 13. The base plate 13 forms part of the device stand for the comminution machine 1.

During milling operation, as a result of the high speeds of centrifugal mills, the laboratory mill 1 produces sound emissions, which are transmitted as airborne and/or structure-borne sound. These signals coupled to the speed of the rotor 3 are very irritating due to the generally high rotational speeds in laboratory use. In conical mills, however, periodic sound emissions occur particularly due to periodic impacts produced by the comminution process. Sound emissions can be produced by the comminution procedure itself, or by a developing air flow that is interrupted cyclically by the periodic comminution procedure.

Airborne sound is then emitted from the milling chamber 4 and into the surrounding area through the milling stock tube 8. If the milling stock tube 8 is open during the milling operation in order to gradually feed the milling stock into the milling chamber 4, there is a continuous airborne-sound path between the emission source in the region of the milling tool and the area surrounding the comminution machine 1. In addition, structure-borne sound emissions occur, which are caused by device and/or housing parts of the comminution machine 1 shaking and vibrating and emanate from the milling chamber 4. These device and/or housing parts can make ambient air vibrate and thus generate airborne sound themselves, and/or strengthen airborne sound emissions through the milling stock tube 8. In addition, vibrating device parts and/or housing parts in turn make adjacent device and/or housing parts vibrate, resulting in the adjacent device parts also potentially emitting airborne sound.

To reduce sound emissions, at least one counter-sound apparatus 14 shown schematically in FIG. 2 can be provided. Said apparatus comprises a control unit 15 for providing a counter-sound signal 16 and at least one actuable sound-generation unit 17, which is shown schematically in FIG. 2 as a speaker. However, the sound-generation unit 17 can also be a piezoelectric actuator, in particular a piezoelectric film. Alternatively to a piezoelectric film, piezoceramic disc elements can also be used. Depending on the actuation, the sound-generation unit 17 generates a counter-sound field 18 for active sound reduction and/or for at least partly eliminating a disruptive-sound field 19 that emanates from the milling chamber 4 and is generated by the rotating milling tool during the comminution process.

As is also clear from FIG. 2, the amplitude and frequency of counter-sound waves 20 generated by the sound-generation unit 17 can substantially correspond to the disruptive-sound waves 21 emanating from the milling chamber 4, although said counter-sound waves are phase-shifted relative to the disruptive-sound waves by preferably 180°. Even if the entire spectrum of the undesired sound cannot be eliminated, at least a significant reduction in sound emissions can still be achieved. FIG. 2 schematically shows that the disruptive-sound field 19 can be almost entirely eliminated as a result of the counter-sound field 18.

The disruptive-sound field 19 emanating from the milling chamber 4 is measured by a microphone 22. The microphone 22 converts the disruptive sound into an interference signal 23, the control unit 15 evaluating the interference signal 23 and generating a counter-sound signal 16 on the basis of the evaluation.

Moreover, a second microphone 24 can be provided to act as an error microphone and transmit an error signal 25 to the control unit 15 if the disruptive sound should not be completely eliminated. This creates a feedback loop system in order to completely eliminate disruptive sound as far as possible. In this case, the control unit 15 is in the form of a closed-loop controller. In principle, however, simple open-loop control on the basis of irritating sound waves 21 incident on the microphone 22 can also be provided for the counter-sound generation. In addition, it is also possible to configure the control unit 15 such that the counter-sound signal 16 can be selected from a number of counter-sound signal profiles available in a memory unit (not shown).

In FIG. 1, options for the spatial arrangement of a counter-sound apparatus 14 on the laboratory mill 1 are shown schematically and are marked by "X."

As is clear from FIG. 1, a counter-sound apparatus 14 can be provided, for example, in the region of a device and/or housing part that indirectly or directly encloses the milling chamber 4. The sound-generation unit 17 or an electroacoustic and/or electromechanical actuator can be arranged on the collection container 6, in particular on the outer wall thereof. An electroacoustic and/or electromechanical actuator can also be integrated in a wall of the collection container 6. Alternatively or additionally, an electroacoustic and/or electromechanical actuator can be arranged on or in the container lid 7 and/or on or in the annular sieve 5.

In addition, it is possible to arrange a sound-generation unit 17 in the region of the wall portion 10 of the housing lid 11 defining the milling stock tube 8 and/or on the housing 12. A sound-generation unit 17 can also be arranged on a side wall 26 of the housing lid 11 spaced apart from the milling stock tube 8. For device and/or housing parts arranged so as to be capable of vibrating, an electromechanical actuator can also interact with a device and/or housing wall and cause said wall to vibrate in order to thus generate counter-sound. The housing wall can then act as a membrane and generate the counter-sound.

It goes without saying that there are further options for arranging a counter-sound apparatus 14 other than the positions X shown in FIG. 1 for a counter-sound apparatus 14.

FIG. 3 schematically shows a counter-vibration apparatus 27 for a laboratory mill 1 shown in FIG. 1. The counter-vibration apparatus 27 preferably has a plurality of sensors 28 and an actuable vibration-generation unit 29. Just one sensor 28 can also be provided. Also provided is a control unit 29*a*, which generates a counter-vibration signal 29*b*. The vibration-generation unit 29 is designed to convert the counter-vibration signal 29*b* into counter-vibrations 30 to actively reduce the vibrations of a device and/or housing part 31, otherwise capable of vibrating, of the comminution machine 1. This ensures that vibrations 32 of the device and/or housing part 31 generated when the laboratory mill 1 is in operation are reduced or even completely eliminated due to the action of the vibration-generation unit 29. As a result, less disruptive sound is emitted.

The vibration-generation unit 29 can be a piezoelectric actuator and/or an electromechanical actuator in the form of a spring-mass vibration system. The vibration-generation unit 29 is preferably placed on the device and/or housing part 31 and/or acts counter to the device and/or housing part 31. In principle, the vibration-generation unit 29 can also be integrated or embedded in a wall of the device and/or housing part 31.

A modular system may also be provided, which comprises at least one vibration-generation unit 29 and at least one sensor 28, preferably a plurality of sensors, and can be used as required for vibration reduction. In order to reduce vibrations in as optimum a manner as possible, it is thus possible to attach at least one vibration-generation unit 29, which can be connected to the device and/or housing part 31, to different points on a device and/or housing part 31 or even to different device and/or housing part parts 31 depending on the vibrations 32 actually occurring during operation of the mill.

The sensors 28 can be formed as accelerometers and are preferably arranged so as to be distributed spatially over the device and/or housing part 31, which in this case is shown as being plate-shaped merely for the purpose of simplifying the illustration. Said sensors are placed on the surface of the device and/or housing part 31 such that the vibrations 32 of the device and/or housing part 31 generated during the milling process are detected. The sensor output signals 28*a* are then fed to the control unit 29*a*, which generates counter-vibration signals 29*b* and transmits these to the vibration-generation unit 29 for active vibration reduction. A microphone can also be provided as a sensor 28 in order to detect disruptive sound emanating from the device and/or housing part 31 during operation in the laboratory and to convert said sound into a sensor output signal 28.

From the counter-vibration signals 29*b*, the vibration-generation unit 29 then generates counter-vibrations 30, which excite the device and/or housing part 31 in phase opposition and counteract the vibrations 32 of the device and/or housing part 31. Vibrations of the device and/or housing part 31 are attenuated. As a result, disruptive sound or noise radiated from the device and/or housing part 31 is significantly reduced or completely eliminated. The signals can be transmitted between the sensors 28, the vibration-generation unit 29 and the control unit 29*a* via radio or by means of control signal lines. The control unit 29*a* can be formed as a closed-loop controller.

FIG. 4 schematically shows possible positions for arranging a counter-vibration apparatus 27 on a comminution machine 1. The counter-vibration apparatus 27 is used to actively excite device and/or housing walls of the comminution machine 1 in phase opposition, in order to reduce vibrations of the device and/or housing walls caused by the milling operation. This also reduces disruptive sound.

The type and design of the laboratory mill 1 shown in FIG. 4 corresponds to the laboratory mill 1 shown in FIG. 1, although a separate feed funnel 33 is inserted into the milling stock tube 8. The feed funnel 33 is formed as a sound absorber and leads to passive reduction of sound emissions by reflecting airborne sound at cross-sectional and/or directional changes in the feed funnel 33.

For example, a counter-vibration apparatus 27 can be provided on or in the region of an outer or inner wall of the housing 12. A counter-vibration apparatus 27 formed accordingly can also be provided in the region of the housing lid 11, in particular in the region of the wall portion 10 defining the milling stock tube 8. The counter-vibration apparatus 27 can be arranged externally or internally on the relevant wall of the housing 12 and/or housing lid 11. It can also be integrated in the wall. FIG. 4 further shows that a counter-vibration apparatus 27 can also be provided directly on the feed funnel 33, preferably on the outer side of the feed funnel 33 facing away from the milling stock.

In the laboratory mill 1 shown in FIG. 4, the base plate 13 rests on a base by means of rubber elements 34. The rubber elements 34 lead to the base plate 13 being passively decoupled from the base and to the transmission of vibrations being passively attenuated. In conjunction therewith, at least one counter-vibration apparatus 27 can be provided in order to excite the base plate 13 in phase opposition and thus to provide additional active decoupling. By exciting the base plate 13 in phase opposition, vibrations of the base plate 13 that generate disruptive sound can be actively reduced and/or at least partly eliminated. Each rubber element 34 can be assigned a counter-vibration apparatus 27.

FIGS. 5 and 6 show alternative embodiments of feed funnels 33 that can be inserted as required into the milling stock tube 8 of a laboratory mill 1 as separate device parts and lead to passive reduction of sound emissions by reflecting airborne sound at cross-sectional and/or directional changes in the funnel 33. For this purpose, the funnel 33 is introduced into the airborne-sound path between the milling chamber 4 and the external air surrounding the comminution machine 1. In the funnel 33, obstacles are placed in the path of the sound waves such that they are reflected and deflected. In the process, the sound waves also cancel each other out in part. By the absorber having different cross sections, the sound is reflected and thus sound levels are reduced. The reduction of sound emissions caused by the geometry of the funnel 33 can be at least 10 dB(A), preferably at least 20 dB(A), particularly preferably at least 30 dB(A).

The feed funnel 33 shown in FIG. 5 has an upper edge portion 35 provided for supporting the feed funnel 33 on the housing lid 11. At its upper end, the feed funnel 33 has a conically tapering funnel portion 36 and a cylindrical neck portion 37 connected to the bottom thereof. At the lower end of the neck portion 37, an anti-splashback guard 38 is provided, which is formed by a conical wall portion 39. The wall portion 39 is held on the neck portion 37 by means of wall portions 40 that are extended in the axial direction in the manner of webs. Milling stock is fed into the milling chamber 4 through an entry opening 41 at the upper end of the feed funnel 33, through the funnel portion 36 and neck portion 37, past the web-shaped wall portions 40 towards the milling chamber 4.

As is now also clear from FIG. 5, at least one counter-vibration apparatus 27, in particular of the type shown in FIG. 3, can be provided externally at different points of the feed funnel 33. In this way, the feed funnel 33 can be actively excited in phase opposition during operation of the laboratory mill 1, leading to vibration reduction and at least partial elimination of vibrations of the feed funnel 33 that generate disruptive sound. The fact that a counter-sound apparatus 14 can alternatively or additionally be provided on the funnel 33 is not shown.

FIG. 6 shows an alternative embodiment of a feed funnel 33 formed in multiple parts. The same reference numerals for the funnels 33 shown in FIGS. 5 and 6 denote the same regions and portions and/or those having the same function. The feed funnel 33 from FIG. 6 comprises an insert 43 having a funnel-shaped wall portion 44, which forms the anti-splashback guard 38 at its lower end. The insert 43 can be held in the entry opening 41 of the feed funnel 33 in a locked manner.

The counter-vibration apparatus 27 can, for example, be provided on an outer edge 42 of the edge portion 35. In addition, a counter-vibration apparatus 27 can be provided on the funnel portion 36 and/or on the neck portion 37 and/or in the region of the anti-splashback guard 38.

In the embodiment shown in FIG. 6, a counter-vibration apparatus 27 can also be provided on the insert 43, counter-vibrations 30 being transmitted to the insert 43 in order to attenuate the vibrations of the insert 43 and reduce or even completely eliminate vibrations and thus disruptive sound emanating from the insert 43 during operation of the laboratory mill 1.

FIG. 7 shows the feed funnel 33 from FIG. 6 after being inserted into the milling stock tube 8 of a laboratory mill 1. As is clear from FIG. 7, milling stock can be fed into the feed funnel 33 in an off-center manner. The milling stock can be fed via a channel 45 guided through a cover 46. The cover 46 covers the feed funnel 33 inserted into the milling stock tube 8 and can lie on the outer edge 42 of the feed funnel 33. A counter-vibration apparatus 27 can also be provided on the cover 46 and/or on the channel 45. The fact that a counter-sound device 14 can also be provided on the cover 46 and/or on the channel 45 is not shown.

The type and design of the laboratory mill 1 shown in FIG. 8 corresponds to those of the laboratory mill 1 shown in FIGS. 1, 4 and 7. Identical components and/or those having the same function have been denoted by the same reference numerals.

The laboratory mill 1 from FIG. 8 comprises a feed funnel 33 that allows milling stock to be fed in an off-center manner. The feed funnel 33 is preferably rotatably inserted into a funnel housing 47. The funnel housing 47 is preferably supported on the housing lid 11 and thus covers the milling stock tube 8. The illustrated geometry of the arrangement consisting of the feed funnel 33 and funnel housing 47 leads to passive sound emission reduction during operation of the comminution machine 1. To reduce the generation of sound emissions, at least one counter-vibration apparatus 27 can be arranged, for example, on the housing lid 11, on the funnel housing 47 or also directly on the feed funnel 33.

The features of the laboratory mills 1 shown in FIG. 1 to 8 are not limited to the collection of features shown in each figure, and features from different embodiments can be combined as required, even if this has not been shown and described specifically.

| List of reference numerals | |
|---|---|
| 1 | laboratory mill |
| 2 | drive shaft |
| 3 | rotor |
| 4 | milling chamber |
| 5 | annular sieve |
| 6 | collection container |
| 7 | container lid |
| 8 | milling stock tube |
| 9 | milling stock inlet opening |
| 10 | wall portion |
| 11 | housing lid |
| 12 | housing |
| 13 | base plate |
| 14 | counter-sound apparatus |

-continued

| List of reference numerals | |
|---|---|
| 15 | control unit |
| 16 | counter-sound signal |
| 17 | sound-generation unit |
| 18 | counter-sound field |
| 19 | disruptive-sound field |
| 20 | counter-sound wave |
| 21 | disruptive-sound wave |
| 22 | microphone |
| 23 | interference signal |
| 24 | microphone |
| 25 | error signal |
| 26 | side wall |
| 27 | counter-vibration apparatus |
| 28 | sensor |
| 28a | vibration signal |
| 29 | vibration-generation unit |
| 29a | control unit |
| 29b | counter-vibration signal |
| 30 | counter-vibration |
| 31 | device and/or housing part |
| 32 | vibration |
| 33 | feed funnel |
| 34 | rubber element |
| 35 | edge portion |
| 36 | funnel portion |
| 37 | neck portion |
| 38 | anti-splashback guard |
| 39 | wall portion |
| 40 | wall portion |
| 41 | entry opening |
| 42 | outer edge |
| 43 | insert |
| 44 | wall portion |
| 45 | channel |
| 46 | cover |
| 47 | funnel housing |

The invention claimed is:

1. A laboratory mill comprising:

at least one counter-vibration apparatus having at least one control unit for providing a counter-vibration signal and at least one actuable vibration-generation unit for converting the counter-vibration signal into counter-vibrations;

wherein the vibration-generation unit acts counter to at least one of a housing lid enclosing a milling chamber and a housing of the laboratory mill;

wherein, by the counter-vibrations, vibrations of the at least one of a housing lid enclosing a milling chamber and a housing of the laboratory mill are actively reduced or vibrations of the at least one of a housing lid enclosing a milling chamber and a housing of the laboratory mill that generate disruptive sound are eliminated at least in part by destructive interference; and wherein the housing of the laboratory mill is configured to be mounted on a base.

2. The laboratory mill according to claim 1, wherein the counter-vibration apparatus is configured to excite the housing of the laboratory mill and housing lid enclosing a milling chamber in phase opposition in a manner coordinated with one another.

3. The laboratory mill according to claim 1, wherein the vibration-generation unit is a piezoelectric actuator or an electromechanical actuator that is placed on the at least one of a housing lid enclosing a milling chamber and a housing of the laboratory mill or that interacts with the at least one of a housing lid enclosing a milling chamber and a housing of the laboratory mill.

4. The laboratory mill according to claim 1, wherein the vibration-generation unit is integrated in a wall of the at least one of a housing lid enclosing a milling chamber and a housing of the laboratory mill.

5. The laboratory mill according to claim 1, wherein at least one sensor is provided for detecting vibrations that generate disruptive sound or for detecting disruptive sound and generating a vibration signal, the control unit being configured to generate the counter-vibration signal by evaluating the vibration signal.

6. The laboratory mill according to claim 1, wherein the vibration-generation unit can be releasably connected to the at least one of a housing lid enclosing a milling chamber and a housing of the laboratory mill or can be attached to different devices or housing parts of the laboratory mill as necessary.

7. The laboratory mill according to claim 1, wherein the control unit comprises at least one adjustment member for manually generating a counter-vibration signal or modifying at least one of a phase position and amplitude of the counter-vibrations.

8. The laboratory mill according to claim 1, wherein at least one sensor is provided for detecting an operational parameter of the laboratory mill, and wherein the control unit provides the counter-vibration signal depending on the detected operational parameter of the laboratory mill.

9. A laboratory mill, comprising:

at least one counter-vibration apparatus having at least one control unit for providing a counter-vibration signal and at least one actuable vibration-generation unit for converting the counter-vibration signal into counter-vibrations;

wherein the vibration-generation unit acts counter to at least one of a feed funnel and a device stand of the laboratory mill;

wherein, by the counter-vibrations, vibrations of the at least one of a feed funnel and a device stand are actively reduced or vibrations of the at least one of a feed funnel and a device stand of the laboratory mill that generate disruptive sound are eliminated at least in part by destructive interference; and wherein the vibration-generation unit is designed and arranged to actively excite the at least one of a feed funnel and a device stand of the laboratory mill in phase opposition.

10. The laboratory mill according to claim 9, wherein the vibration-generation unit is a piezoelectric actuator or an electromechanical actuator that is placed on the at least one of a feed funnel and a device stand of the laboratory mill or interacts with the at least one of a feed funnel and a device stand of the laboratory mill.

11. The laboratory mill according to claim 9, wherein at least one sensor is provided for detecting vibrations that generate disruptive sound or for detecting disruptive sound and generating a vibration signal, the control unit being configured to generate the counter-vibration signal by evaluating the vibration signal.

12. The laboratory mill according to claim 9, wherein the vibration-generation unit can be releasably connected to the at least one of a feed funnel and a device stand of the laboratory mill or can be attached to different devices or housing parts of the laboratory mill as necessary.

13. The laboratory mill according to claim 9, wherein the control unit comprises at least one adjustment member for manually generating a counter-vibration signal or modifying at least one of a phase position and amplitude of the counter-vibrations.

14. The laboratory mill according to claim 9, wherein at least one sensor is provided for detecting an operational parameter of the laboratory mill, and wherein the control unit provides the counter-vibration signal depending on the detected operational parameter of the laboratory mill.

15. A laboratory mill, comprising:

at least one counter-sound apparatus having a control unit for providing a counter-sound signal and at least one actuable sound-generation unit for converting the counter-sound signal into counter-sound to actively reduce sound or eliminate disruptive sound at least in part by means of destructive interference; and wherein the sound-generation unit is arranged on or interacts with another device or housing part directly or indirectly adjacent to a sound-emitting device or housing part.

16. The laboratory mill according to claim 15, wherein the sound-generation unit is a piezoelectric actuator, a piezoelectric film, or a speaker that generates a counter-sound field according to its actuation.

17. The laboratory mill according to claim 15, wherein the sound-generation unit is an electromechanical actuator that interacts with the at least one of a device and a housing part capable of vibrating, the at least one of a device and a housing part being made to vibrate by displacements of the actuator and generating a counter-sound field as a result.

18. The laboratory mill according to claim 15, wherein at least one sound sensor is provided for converting disruptive sound into an interference signal, the control unit being configured to generate the counter-sound signal by analyzing the interference signal.

* * * * *